US005781812A

United States Patent [19]

Masuda et al.

[11] Patent Number: 5,781,812

[45] Date of Patent: Jul. 14, 1998

[54] METHOD AND DEVICE FOR COUPLING A FILM STRIP TO A PROCESSING LEADER SHEET

[75] Inventors: Shigeru Masuda; Keigo Arimoto, both of Wakayama, Japan

[73] Assignee: Noritsu Koki Co., Ltd., Wakayama, Japan

[21] Appl. No.: 715,143

[22] Filed: Sep. 18, 1996

[30] Foreign Application Priority Data

Sep. 18, 1995 [JP] Japan ..... 7-238233

[51] Int. Cl.[6] ..... G03D 13/10

[52] U.S. Cl. ..... 396/411; 396/599; 396/647

[58] Field of Search ..... 396/411, 415, 396/598, 599, 612, 647, 651, 646

[56] References Cited

U.S. PATENT DOCUMENTS 4,110,774 8/1978 Krehbiel et al. ..... 396/646
4,860,044 8/1989 Kanai et al. ..... 396/646
5,381,204 1/1995 Grusetski et al. ..... 396/646
5,463,441 10/1995 Yamaguchi ..... 396/646

FOREIGN PATENT DOCUMENTS 0624822 11/1994 European Pat. Off. .
0738923 4/1996 European Pat. Off. .

*Primary Examiner*—David M. Gray
*Attorney, Agent, or Firm*—Smith Patent Office

[57] ABSTRACT

A leader section of a film strip having coupler holes in the leading section is inserted into a film guide concavity of a coupling table through a rear slot of a leader sheet placed on the coupling table. The film strip is continuously forced to slide along a curved surface of the film guide concavity until the front end of the leader section of the film strip passes through a front slot of the leader sheet. While the leader section moves through the front slot of the leader sheet, it pushes and bends the coupler tongues upward and lets the coupler tongues snap back and enter the coupler holes of the film strip to bring the coupler tongues into engagement with the coupler holes. Finally, by pulling back and stretching the film strip tight, the film strip is coupled to the leader sheet.

12 Claims, 4 Drawing Sheets

METHOD AND DEVICE FOR COUPLING A FILM STRIP TO A PROCESSING LEADER SHEET

BACKGROUND OF THE INVENTION

1. Field of the Invention

This invention relates to a method of coupling a film strip to a processing leader sheet by means of which the film strip is transported in an automatic film processing apparatus and a device for coupling the film strip to the processing leader sheet.

2. Description of the Related Art

In cases where film strips are processed by automatic film processing apparatuses of the type using what is called a leader sheet or simply a leader sheet, a leader sheet, to which film strips are spliced, is moved along a film processing path of the automatic film processing apparatus to haul the film strips through the processing path. Typically, as shown in FIG. 6, film strips F that are drawn out of film cartridges or film patroness P are spliced to a leader sheet L together by means of pieces of splicing tape T such as an adhesive tape. Leader sheets L of this kind, which are typically made of flexible plastic sheets, have a lengthwise row of perforations a formed therein at regular intervals. Such a leader sheet L attached with film strips F is moved by means of a motor-driven sprocket wheel along the film processing path through engagement between the perforations and the teeth of the sprocket wheel.

In the event that a film strip F is accidentally detached from the leader sheet L during film processing, the film strip F comes to a standstill in a processing tank and ends in a failure in processing. Further, it is hard to bring the film strip F out of the processing tank and there is significant apprehension about exposing the film strip to light during removal of the film strip F. In order to prevent the film strips F from being detached from the leader sheet L, the film strips must be strongly spliced to the leader sheet L.

Because the film strips F and the leader sheet L must be spliced in precise relative positions, the use of the splicing tape T makes it necessary to employ a special work table. Additionally, use of the splicing tape T encounters a somewhat troublesome operation of attaching it to and removing it from the leader sheet L. Further, the splicing tape T is difficult to reuse and therefore is somewhat wasteful.

A coupler type of leader sheet has been proposed in, for instance, Japanese Patent Application No. 7-168783 owned by the assignee of this application. This type of leader sheet is available for film strips of the type having a pair of coupling holes transversely located in its leader section. Stated briefly, the leader sheet has a pair of transverse slots, namely a front slot and a rear slot, formed in close proximity to the trailing end and a pair of coupler tongues separated transversely at a distance and extending across over the front slot. For coupling the film strip to the leader sheet, the leader section of the film strip is passed first through the rear slot from the front side to the back side of the leader sheet and then through the front slot from the back side to the front side of the leader sheet pushing and bending the coupler tongues upward. As soon as the coupler tongues encounter the coupling holes of the leader section during upward movement of the leader section of the film strip, the coupler tongues snap back and enter the coupling holes of the leader section to couple the film strip to the leader sheet. This type of leader sheet provides an easy coupling operation and precise coupling of the film strips. The coupler tongues extending rearward, namely in a direction opposite to the direction of movement of the leader sheet, are not caught in the film processing path of the automatic processing apparatus during movement of the film leader nor accidentally release the film strip from the leader sheet. Furthermore, the pair of transversal slots prevent the film strip coupled to the leader sheet from swaying laterally as it snakes its way through the processing path.

While the coupling type film leader provides precise coupling of the film strips thereto and eliminates the use of splicing tapes which are always wasteful, the film processing apparatus operators are still required to be proficient in the coupling operation.

SUMMARY OF THE INVENTION

It is an object of the present invention to provide an easy method of coupling film strips to a coupling type leader sheet.

It is another object of the present invention to provide a device for providing an easy coupling method.

According to the present invention, a film strip having a coupler hole formed in a leading section of the film strip is coupled to a leader sheet, for hauling the film strip through a processing path of an automatic processing apparatus. The leader sheet has transverse front and rear slots separated in a longitudinal direction of the leader sheet and a pair of coupler tongues which extend across the front slot and are engaged by the coupler hole of the film strip, so as to couple the film strip to the leader sheet. For coupling the film strip to the leader sheet, the leader sheet is placed in a specified position on a coupling table having a film guide concavity defined by a curved surface. In the specified position, a rear edge of the front slot of the film trailing leader sheet lays above an aperture of the film guide concavity and is located in close proximity to the front edge of the aperture of the film guide concavity. Further, a rear edge of the rear slot of the leader sheet lays along the rear edge of the aperture of the film guide concavity. Subsequently, the leader section of the film strip is inserted into the film guide concavity of the coupling table through the rear slot from the front side to the back side of the leader sheet and continuously forced to move the leader section of the film strip along the curved surface until the front end of the leader section of the film strip passes through the front slot from the back side to the front side of the leader sheet. While the leader section moves through the front slot of the leader sheet, it pushes and bends the coupler tongues upward and lets the coupler tongues of the leader sheet snap back and enter the coupler holes of the film strip to bring the coupler tongues of the leader sheet into engagement with the coupler holes of the film strip. Finally, by pulling back and stretching the film strip tight, the film strip is coupled to the leader sheet.

BRIEF DESCRIPTION OF THE DRAWINGS

The above and other objects and features of the present invention will be clearly understood from the following description with respect to the preferred embodiments thereof when considered in conjunction with the accompanying drawings, in which.

DETAILED DESCRIPTION OF THE PREFERRED EMBODIMENTS

Figure 1:
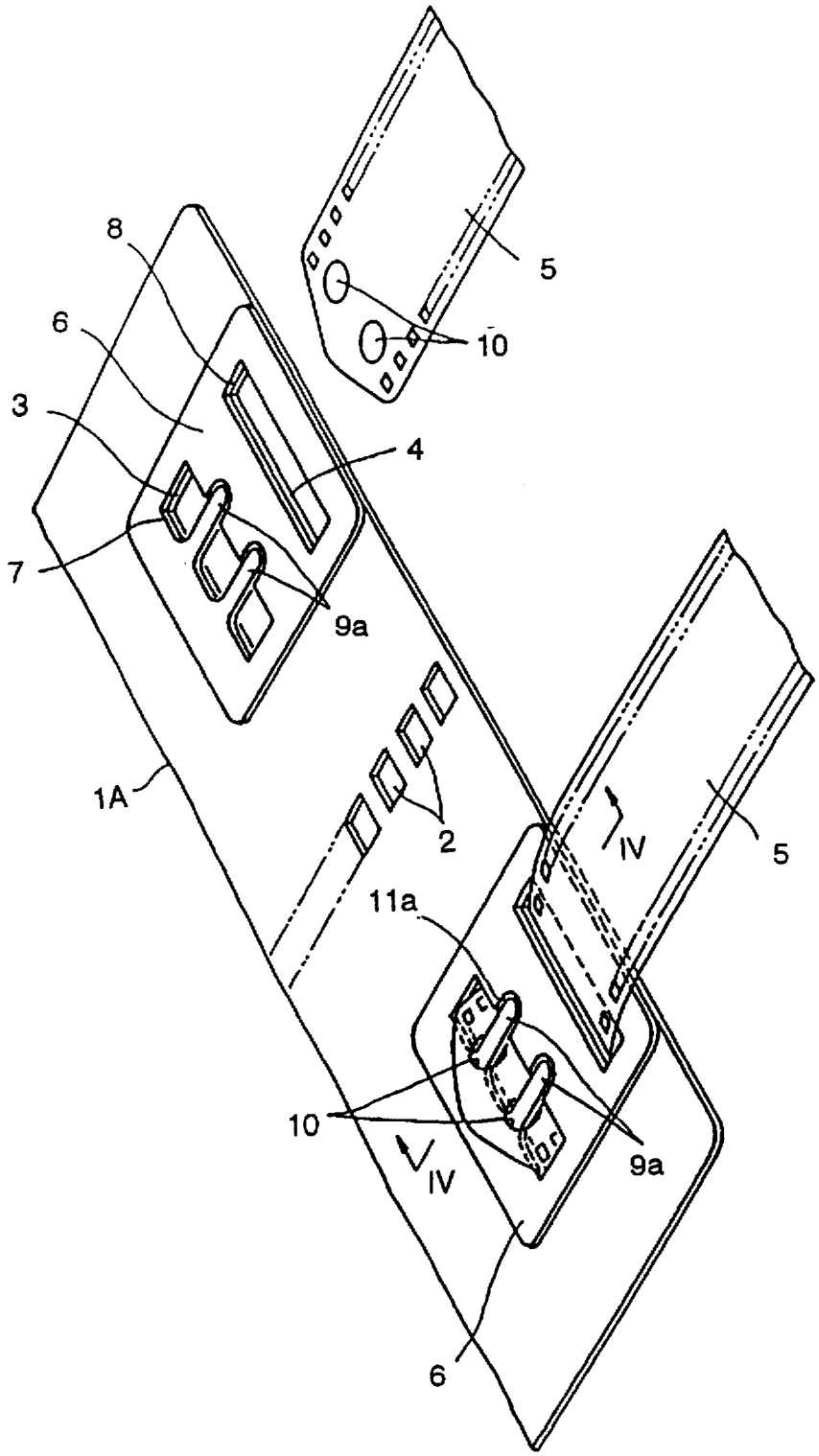
FIG. 1 is a schematic illustration showing a film leader sheet and film strips to be coupled to the film leader sheet.

Referring to the drawings in detail, and in particular to FIG. 1, there is shown a trailing section of a generally rectangularly-shaped leader sheet 1A and leader sections of film strips 5, one of these film strips 5 having been coupled to the leader sheet 1A and another before being coupling. The leader sheet 1A is made of a plastic sheet and formed with a straight row of perforations 2 along the longitudinal center line. These perforations 2 are engaged by teeth of driving sprockets of an automatic processing apparatus (not shown) to move the leader sheet 1A along a processing path of the automatic processing apparatus in a well known manner. On each side of the row of perforations 2, the leader sheet 1A is formed with a pair of slots, namely a front slot 3 and a rear slot 4, extending transversely and arranged in parallel to each other. Each slot 3, 4 has a length in a transverse direction of the leader sheet 1A approximately equal to the width of the leader section of the film strip 5 and allows the leader section of the film strip 5 to pass easily therethrough. Each slot 3, 4 has a width in a lengthwise direction of the leader sheet 1A sufficiently wide for the leader section of the film strip 5 to pass therethrough. A coupler pad 6 is bonded, or otherwise secured, to the trailing section of the leader sheet 1A with its rear edge lying along the rear edge of the leader sheet 1A. In more detail, the coupler pad 6 is made of a plastic sheet and formed with front and rear slots 7 and 8 which conform in size to the front and rear slots 3 and 4 of the leader sheet 1A, respectively. Further, the coupler pad 6 is formed integrally with coupler tongues 9*a* arranged in parallel to each other at a specified distance. Each coupler tongue 9*a* extends across over the front slot 7, and the rounded free end of the coupler tongue 9*a* is received within a semi-circular notch 11*a* and placed on the marginal section surrounding the front slot 3 of the leader sheet 1A.

The film strip 5 has a pair of coupling holes 10 separated transversely at a specified distance. It is a matter of course that each coupler tongue 9*a* has a width approximately equal to or slightly smaller than the diameter of the coupling hole 10 and the coupler tongues 9*a* are at the same distance as the specified distance at which the coupling holes 10 are arranged. The film strip 5 is coupled to the leader sheet 1A by the use of a coupling device 20 having a flat top surface 20*a* such as shown in FIGS. 2 and 3.

Figure 2:
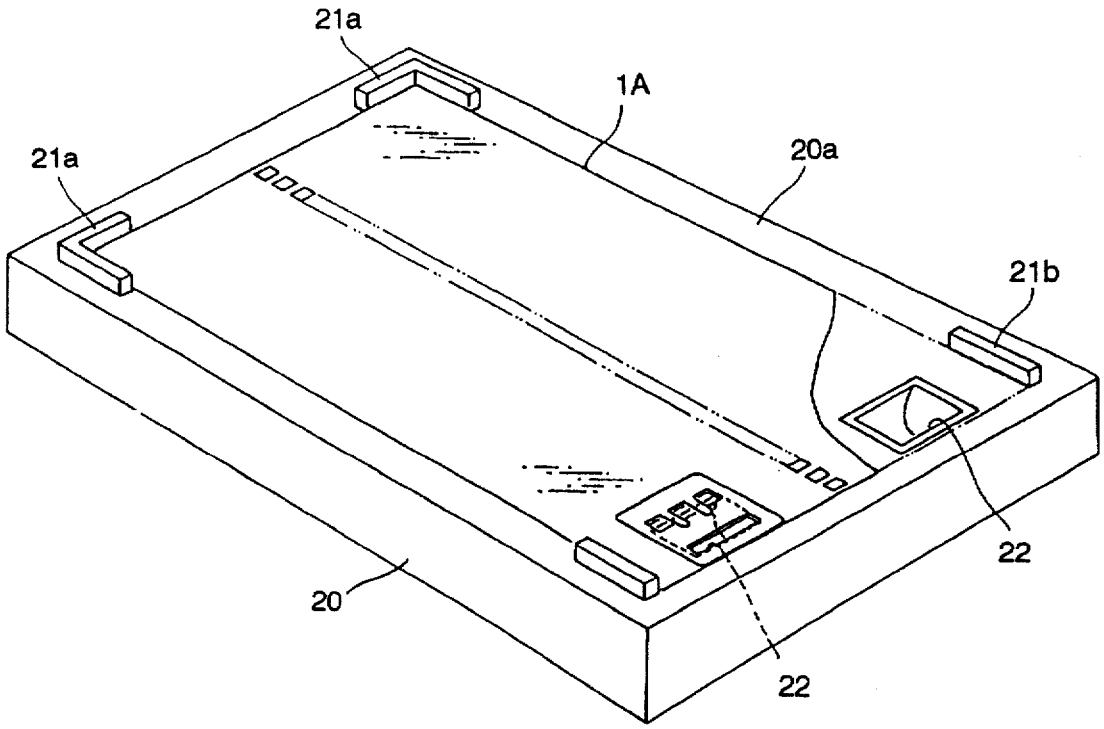
FIG. 2 is a perspective view of a coupling table on which the leader sheet is placed in position according to an embodiment of the invention.
Figure 3:
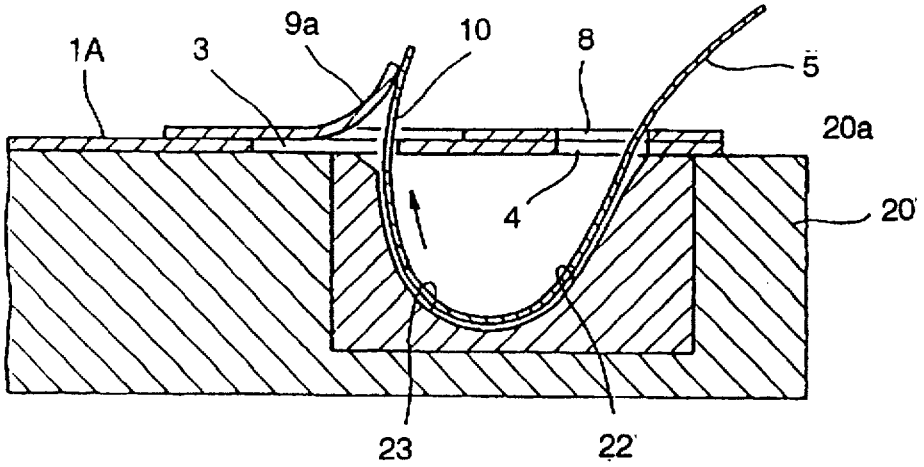
FIG. 3 is a cross-sectional view of the coupling table with the leader sheet placed thereon and a film strip about to be coupled to the trailing section of the film leader sheet.

Referring to FIGS. 2 and 3, the coupling device 20 has a pair of film guide concavities 22 separated transversely at a distance and located in proximity to the rear end thereof. Each film guide concavity 22 is defined by a generally elliptical arcuate guide surface 23. The coupling device 20 is formed on the flat top surface 20*a* and an L-shaped positioning guide 21*a* is located in close proximity to each rear corner and a side guide 21*b* is located on an outer side of each film guide concavity 22. These guides 21*a* and 21*b* place the leader sheet 1A in a position on the coupling device 20 such that the rear edge of the front slot 3 of the leader sheet 1A lays above the aperture of the film guide concavity 22 and is located in close proximity to the front edge of the aperture of the film guide concavity 22. Further, the rear edge of the rear slot 4 of the leader sheet 1A lays along the rear edge of the aperture of the film guide concavity 22.

Figure 4:
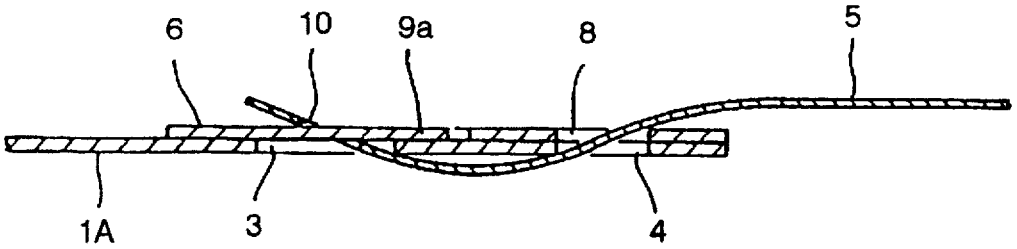
FIG. 4 is a cross-sectional view of FIG. 1 taken along line IV—IV.

After having placed the leader sheet 1A on the coupling device 20, the leader section of the film strip 5 is inserted into the film guide concavity 22 through the rear slots 4 and 8 of the leader sheet 1A and the coupler pad 8, respectively. The film strip is then forced toward the front slots 3 and 7 of the leader sheet 1A along the guide surface 23. When the leading end of the leader section of the film strip 5 reaches the front slot 3 of the leader sheet 1A, it abuts against the coupler tongues 9*a*. As the film strip 5 is forced further, the leader section of the film strip 5 pushes and bends the coupler tongues 9*a* upward. When the film strip 5 is forced still further in the cavity it locates the coupling holes 10 at a position where the rounded free ends of the bent coupler tongues 9*a* encounter the coupling holes 10 of the leader section. At this point the coupler tongues 9*a* snap back and enter the coupling holes 10 of the leader section of the film strip 5. Thereafter, when the film strip 5 is gently pulled back and stretched tight, the coupler tongues register their rounded free ends into the semi-circular notches 11*a*, thereby coupling the film strip 5 to the leader sheet 1A as shown in FIGS. 1 and 4.

It is effective to push the rear section of the leader sheet 1A against the coupling device 20 with fingers or by means of a holding member in order to prevent the leader sheet 1A from rising upward from the top surface 20*a* of the coupling device 20 while the leader section of the film strip 1A pushes the coupler tongues 9*a* upward.

Figure 5:
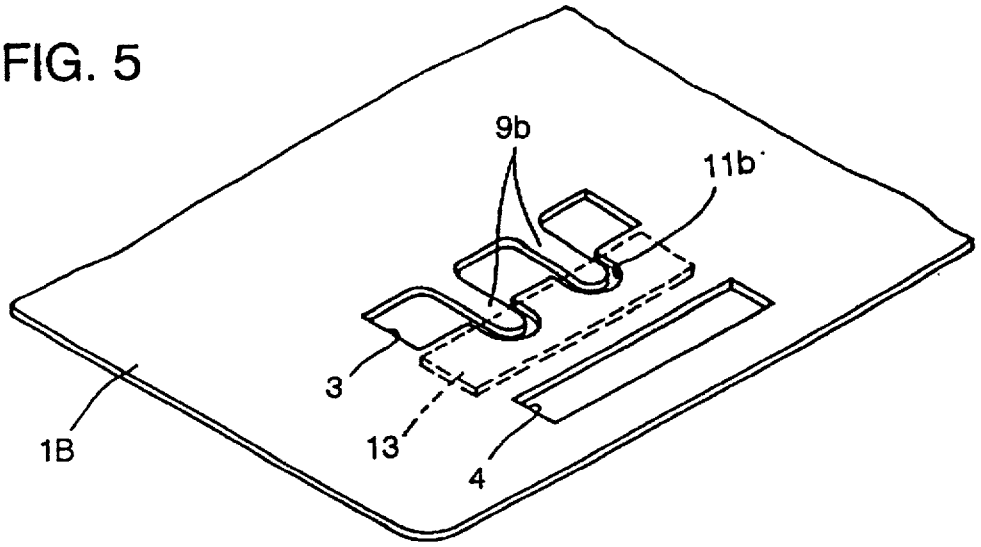
FIG. 5 is a perspective view showing a trailing section of another type of leader sheet.
Figure 6:
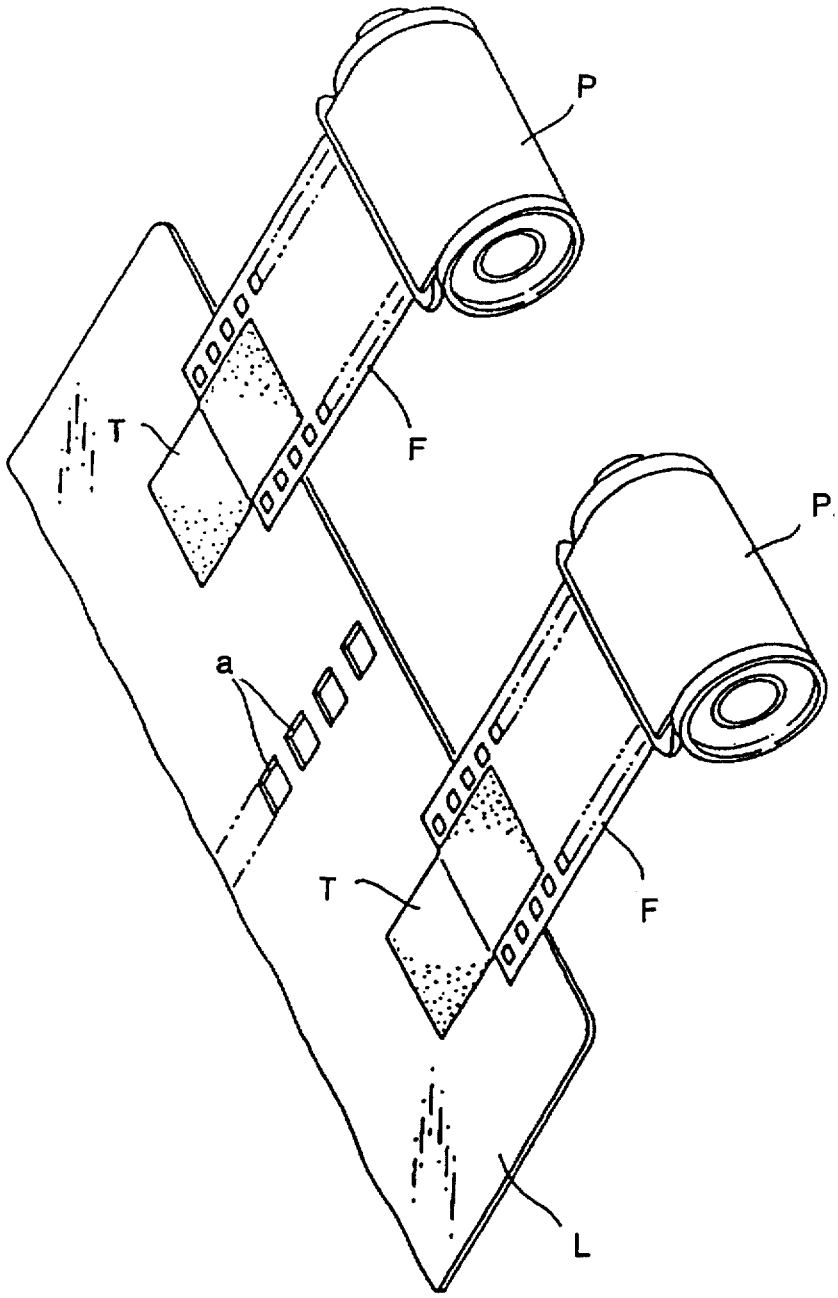
FIG. 6 (PRIOR ART)
FIG. 6 is an illustration showing a prior art leader sheet to which film strips are spliced with splicing tape.

FIG. 5 shows a modification of the leader sheet 1A. A leader sheet 1B may be formed integrally with coupler tongues 9*b* extending across over the front slot 3 and having semi-circular notches 11*b* for receiving the rounded free ends of the coupler tongues 9*b* therein. In this case, in order to prevent the coupler tongues 9*b* from slipping off from the coupler holes 10 of the film strip 1, a backing sheet 13 is bonded, or otherwise secured, to the back of the leader sheet 1B so as to prevent the coupler tongues 9*b* from bending downward.

At least the coupler tongues 9*a* or 9*b* and coupler holes 10 are desirable to couple precisely a film strip 5 to the film leader sheet 1 without inclination therebetween.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A film coupling device for coupling a film strip having a coupler hole formed in a leading section of the film strip for leading the film strip through a processing path of an automatic processing apparatus, said film coupling device comprising:

a leader sheet having transverse front and rear slots spaced apart in a longitudinal direction of said leader sheet and a coupler tongue which extends across the front slot and is engaged by the coupler hole of the film strip so as to couple the film strip to said leader sheet;

a table having a flat top surface for receiving the leader sheet, said table including film guide means defined by a curved surface formed in the table so as to form an aperture in the flat top surface of the table for guiding the film strip inserted through the rear slot of the leader sheet toward the front slot of the leader sheet, said aperture being shaped such that, when the leader sheet is placed in a specified position on the flat top surface of the table, a rear edge of the front slot of the leader sheet lays above the aperture and is located in close proximity to a front edge of the aperture and a rear edge of the rear slot of the leader sheet is in close proximity to a rear edge of the aperture.

2. A film coupling device as defined in claim 1, wherein said coupler tongue is integral with said leader sheet.

3. A film coupling device as defined in claim 2, further comprising a backing sheet disposed on a back side of said leader sheet.

4. A film coupling device as defined in claim 3, wherein said leader sheet includes a semicircular notch disposed above a portion of said backing sheet wherein an end of said coupler tongue contacts said backing sheet.

5. A film coupling device as defined in claim 1, further comprising a coupler pad disposed on a front side of said leader sheet and wherein said coupler pad includes said coupler tongue and a front slot and a rear slot.

6. A film coupling device as defined in claim 5, wherein said coupler pad includes a semicircular notch disposed therein so that an end of said coupler tongue rests on said leader sheet.

7. A film coupling device as defined in claim 1, further comprising a film positioning guide means for placing the leader sheet in a specified position on the flat top surface of the table.

8. A film coupling device as defined in claim 1, wherein the aperture has a width approximately equal to a width of the leader section of the film strip.

9. A film coupling device as defined in claim 1, wherein the film guide means is provided on each side of a center line of the table.

10. A method of coupling a film strip having a coupler hole formed in a leading section of the film strip to a film leader sheet for hauling the film strip through a processing path of an automatic processing apparatus, the leader sheet having transverse front and rear slots spaced apart in a longitudinal direction of the leader sheet, the leader sheet further having a coupler tongue which extends across the front slot and engages the coupler hole of the film strip so as to couple the film strip to the leader sheet, the method comprising the steps of:

placing the leader sheet in position on a coupling table with a film guide concavity defined by a curved surface such that a rear edge of the front slot of the leader sheet lays above an aperture of the film guide concavity and is located in close proximity to the front edge of the aperture of the film guide concavity and a rear edge of the rear slot of the leader sheet lays along the rear edge of the aperture of the film guide concavity;

inserting the leading section of the film strip into the film guide concavity of the coupling table through the rear slot from a front side of the leader sheet to a back side of the leader sheet;

forcing the film strip to move the leading section of the film strip along the curved surface until a front end of the leader section of the film strip passes through the front slot from the back side of the leader sheet to the front side of the leader sheet;

permitting the coupler tongue of the leader sheet to snap back and enter the coupler hole of the film strip thereby bringing the coupler tongue of the leader sheet into engagement with the coupler hole of the film strip; and pulling back and stretching the film strip tight.

11. A method of coupling as defined in claim 10, wherein the coupler tongue is integral with the leader sheet and a backing sheet is located on the back side of the leader sheet, said method further comprising the step of contacting the coupler tongue with the backing sheet following said step of permitting the coupler tongue to snap back following engagement with the coupler hole of the film strip.

12. A method of coupling as defined in claim 10, wherein the coupler tongue is integral with a coupler pad located on a front side of the leader sheet, said method further comprising inserting the leading section of the film strip into a rear slot in the coupler pad prior to said step of inserting the leading section of the film strip into the film guide concavity.

* * * * *